US005409639A

United States Patent [19]

Fusiak et al.

[11] Patent Number: 5,409,639

[45] Date of Patent: Apr. 25, 1995

[54] HARDWOOD FLOOR CLEANER COMPOSITION

[75] Inventors: Frank Fusiak, Bayonne; Kolazi S. Narayanan, Palisades Park, both of N.J.

[73] Assignee: Verona Inc., Greenville, S.C.

[21] Appl. No.: 82,315

[22] Filed: Jun. 25, 1993

[51] Int. Cl.[6] ..... C11D 3/28; C11D 1/14

[52] U.S. Cl. ..... 252/542; 252/174.23; 252/174.24; 252/549; 134/42

[58] Field of Search ..... 252/542, 174.23, 174.24, 252/549; 134/42

[56] References Cited

U.S. PATENT DOCUMENTS

| | | | |
|---|---|---|---|
| 4,230,605 | 10/1980 | Connolly et al. | 252/545 |
| 4,368,146 | 1/1983 | Aronson et al. | 252/542 |
| 4,710,374 | 12/1987 | Grollier et al. | 424/61 |
| 5,041,235 | 8/1991 | Kilbarger | 252/170 |
| 5,080,888 | 1/1992 | Grollier et al. | 424/61 |
| 5,093,031 | 3/1992 | Login et al. | 252/357 |
| 5,252,245 | 10/1992 | Garabedian et al. | 252/153 |

FOREIGN PATENT DOCUMENTS

| | | |
|---|---|---|
| 0467472 | 1/1992 | European Pat. Off. . |
| 2650291 | 7/1990 | France . |
| 50-10274 | 4/1975 | Japan . |

*Primary Examiner*—Paul Lieberman
*Assistant Examiner*—Kery Fries
*Attorney, Agent, or Firm*—Walter Katz; Marilyn J. Maue; Joshua J. Ward

[57] ABSTRACT

A hardwood floor cleaner composition is provided which is non-tacky, and cleans and shines in one-step, is free of silicones, does not dull the wood surface. The composition comprises (a) about 0.1–5%, preferably 0.2–2%, of a $C_6$–$C_{24}$ alkyl pyrrolidone, preferably N-octyl-pyrrolidone; (b) about 0.1–5%, preferably 0.2–1%, of an anionic or nonionic surfactant, preferably sodium dodecyl sulfate; (c) about 1–5%, preferably 2–4%, of a shine booster, preferably a vinylpyrrolidone copolymer, such as vinylpyrrolidone-dimethylamino-ethyl methacrylate (Gafquat® 755-N - ISP); and (d) about 0.5–2%, preferably 0.8–1.5%, of a film-former, for example, an acrylic emulsion, preferably Esi-Cryl® 405 (Emulsion Systems Inc.), which is 2-methyl-2-propenoic acid, copolymer with ethyl-2-propenoate, methyl-2-methyl propenoate and 2-propenoic acid, and (e) about 85–95%, preferably 88–93%, of water, or an alcohol, or mixtures thereof, by weight of the composition. A concentrate and an aqueous microemulsion of the composition of the invention also is provided herein.

5 Claims, No Drawings

HARDWOOD FLOOR CLEANER COMPOSITION

BACKGROUND OF THE INVENTION

1. Field of the Invention

This invention relates to hardwood floor cleaner compositions, and, more particularly, to a composition for this use which is non-tacky, cleans and shines in one-step, is free of silicones, and does not dull the wood surface being cleaned.

2. Description of the Prior Art

EPA 0467472A2 discloses a hard surface liquid cleaning composition with an anti-soiling polymer, which, however, is primarily used for bathroom porcelain and tiles. U.S. Pat. No. 4,368,146 describes a light duty hand dishwashing liquid detergent composition for kitchen utensils and glasses.

DETAILED DESCRIPTION OF THE INVENTION

In the hardwood floor cleaner composition herein, component (a) is a $C_6$–$C_{24}$ alkyl pyrrolidone which functions effectively to clean the floor. Most preferred are alkyl pyrrolidones selected from N-octylpyrrolidone, N-dodecylpyrrolidone or mixtures thereof. Suitably component (a) is present in the composition in an amount of about 0.1–5%, preferably 0.2–2%, by weight of the composition.

Component (b) of the composition is a surfactant, and is preferably an anionic or nonionic surfactant. As representative of the anionic surfactant, alkali metal salts of $C_8$–$C_{22}$ aliphatic surfactants such as sodium dodecyl sulfate or sulfonate, alkali metal salts of alkyl aromatic sulfonates or sulfates, and ethoxylated derivatives of the above, such as the alkylphenyl ethoxylated phosphate esters, may be used. The anionic surfactants are believed to form pseudo salts or ion pairs with the higher alkyl pyrrolidone component (a), which can produce an advantageous synergistic effect on wetting and surface spreading for the composition. Sodium dodecyl (lauryl) sulfate is a preferred anionic surfactant. Component (b) suitably is present in an amount of about 0.1–5%, preferably 0.2–1%, by weight of the composition.

In combination, components (a) and (b) of the composition of the invention in a solvent such as water or alcohol, or mixtures thereof, provide a clear to slightly hazy aqueous microemulsion.

Component (c) of the composition provides a shine booster function for the composition. Suitable shine boosters are copolymers of vinylpyrrolidone, such as a copolymer of vinylpyrrolidone-dimethylaminoethyl methacrylate (Gafquat® 755-N - ISP); vinylpyrrolidone-vinyl acetate, vinylpyrrolidone-acrylic acid; and vinylpyrrolidone-methaminopropyl trimethyl ammonium chloride. The shine booster is present in the composition in an amount of about 1–5% as supplied, preferably 2–4%, of the composition; or 0.2 to 1.0% based on the solids content of the composition.

Component (d) of the composition provides a film-former function for the composition; it is present in an amount of about 0.5–2%, preferably 0.8–1.5%, of the composition. Suitable film-formers are acrylic emulsions, such as Esi-Cryl® 405 sold by Emulsion Systems Inc., which is a copolymer of 2-methyl-2-propopenoic acid with ethyl-2-propenoate, methyl-2-methylpropenoate and 2-propenoic acid; styrene acrylic emulsion sold as Carboset® (Union Carbide); acrylic emulsions sold as Conrez® (Morton Int.); and Joncryl® (S. C. Johnson).

The combination of components (c) and (d) in the compositions forms a barrier of a water-film on the hardwood surface which prevents or reduces contact of the surface with oil or dirt thus keeping the appearance of the surface shiny and clean-looking.

Component (e) of the composition is water, or alcohol, or mixtures thereof, in an amount of about 85–95%, preferably 88–93%, by weight of the composition.

Optional ingredients in the composition of the invention include a neutralizing agent for the acrylic emulsion to make it clear; a plasticizer; a fragrance; a bittering agent; dyes; and auxiliary surfactants to improve leveling.

The composition may be applied to a wood surface by spraying, then damp mopping, or the concentrate may be added to a bucket of water, mixed, and then applied using a damp mop.

TABLE 1

CONCENTRATE

| Component | Suitable | Preferred |
|---|---|---|
| (a) Surfadone LP-100 | 1–50 | 6.12 |
| (b) Stepanol WAC | 1–50 | 10.20 |
| (c) GAFQUAT 755-N | 10–50 | 25.51 |
| (d) Esi-Cryl 405 | 5–50 | 24.49 |
| (e) Isopropanol or Water | 10–70 | 30.61 |
| Lemon Fragrance | | 1.02 |
| Zonyl FSO | | 2.04 |
| Ammonium hydroxide | | 1.30 |

The microemulsion composition of the invention is made by a given amount of the concentrate with water, or alcohol, or mixtures thereof, in a 1:10 ratio. The resultant aqueous microemulsion composition is shown in Table 2 below.

TABLE 2

AQUEOUS MICROEMULSION COMPOSITION

| | Preferred |
|---|---|
| (a) Surfadone LP-100 | 0.6 |
| (b) Stepanol WAC | 1.0 |
| (c) GAFQUAT 755-N | 2.5 |
| (d) Esi-Cryl 405 | 2.4 |
| (e) Deionized water | 90.2 |
| Isopropanol | 3.0 |
| Lemon Fragrance | 0.1 |
| Zonyl FSO | 0.2 |
| Ammonium Hydroxide Q.S. to pH = 8.5 | |

The compositions listed in the Table below were prepared by mixing the several components of the composition at ambient conditions in the order listed until a clear, homogeneous solution was obtained. Then 5.0 g of each formulation was applied onto a clean glass plate, and wiped evenly with a damp sponge and allowed to air-dry. The resultant appearance of the film was evaluated for clarity and tackiness. Formulations that produced clear, non-tacky films were tested on hardwood floor tiles as follows: 5 ml of a given formulation was applied to a 6 inch by 6 inch prefinished TopFlor Oak Grain Parquet Genuine Hardwood Floor Tile and wiped clean over the surface with a damp sponge. After air drying, the 60° specular gloss was measured before and after cleaning using a BYK-Gardner micro-TRI-gloss gloss meter, and the change in gloss was calculated. The results are shown below in Table 3.

TABLE 3

| Components | EXAMPLES 1-6 COMPOSITIONS 1 | 2 | 3 | 4 | 5 | 6 | 7 |
|---|---|---|---|---|---|---|---|
| (a) Surfadone ® LP-100 | 0.6 | 0.6 | 0.6 | 0.6 | 0.6 | 0.6 | 0.6 |
| (b) Sodium lauryl sulfate (29%) | 1.0 | 1.0 | 1.0 | 1.0 | 1.0 | 1.0 | 1.0 |
| (c) GAFQUAT ® 755-N | 2.5 | — | 5.0 | 2.5 | — | — | — |
| PVP/VA E-335 | — | — | — | — | 2.0 | — | — |
| PVP/VA E-735 | — | — | — | — | — | 2.0 | — |
| GAFQUAT-100 | — | — | — | — | — | — | 5.0 |
| (d) Esi-Cryl 405 | — | 2.5 | 2.4 | 2.4 | 2.4 | 2.4 | 2.4 |
| Zonyl FSO | 0.2 | 0.2 | 0.2 | 0.2 | 0.2 | 0.2 | 0.2 |
| Lemon Fragrance | 0.1 | 0.1 | — | — | — | — | — |
| (e) Deionized water | 92.6 | 92.6 | 87.7 | 90.3 | 90.8 | 90.8 | 87.7 |
| Isopropanol | 3.0 | 3.0 | 3.0 | 3.0 | 3.0 | 3.0 | 3.0 |
| Ammonium hydroxide | Q.S. to pH = 8.5 | | | | | | |
| Results | | | | | | | |
| Glass test | clear | clear | clear | clear | hazy | hazy | hazy |
| % Gloss Change on Hardwood Floor | 5.8 | −2.5 | 50.3 | 19.1 | n.t. | n.t. | n.t. |

While the invention has been described with particular reference to certain embodiments thereof, it will be understood that changes and modifications may be made which are within the skill of the art. Accordingly, it is intended to be bound only by the following claims, in which:

What is claimed is:

1. A hardwood floor cleaner composition consisting essentially of by weight of the composition, which is non-tacky, and cleans and shines in one-step, is free of silicones, and does not dull the wood surface (a) about 0.1–5% of a $C_6$–$C_{24}$ alkyl pyrrolidone which is selected from the group consisting of N-octylpyrrolidone and N-dodecylpyrrolidone;

(b) about 0.1–5% of a surfactant which is selected from the group consisting of sodium dodecyl sulfate, sodium dodecyl sulfonate; a sodium salt of an alkyl aromatic sulfonate or sulfate, and ethoxylated derivatives thereof;

(c) about 1–5% of a shine booster which is selected from the group consisting of a copolymer of vinylpyrrolidone and dimethylaminoethyl methacrylate, a copolymer of vinylpyrrolidone and acrylic acid, a copolymer of vinylpyrrolidone and vinyl acetate; and a copolymer of vinylpyrrolidone and methaminopropyl trimethyl ammonium chloride;

(d) about 0.5–2% of a film-former selected from the group consisting of an acrylic emulsion of 2-methyl-2-propenoic acid copolymer with ethyl-2-propenoate, and methyl-2-methyl propenoate and 2-propenoic acid, and (e) about 85–95% of water or alcohol, or mixtures thereof.

2. A hardwood floor cleaner according to claim 1 wherein:

(a) is about 0.2–2%, (b) is about 0.2–1%, (c) is about 2–4%, (d) is about 0.8–1.5%, and (e) is about 88–93%.

3. A hardwood floor cleaner according to claim 1 wherein:

(e) is predominately water.

4. A hardwood floor cleaner according to claim 1 wherein:

(a) is N-octylpyrrolidone, (b) is sodium dodecyl sulfate, (c) is a copolymer of vinylpyrrolidone and dimethylaminoethyl methacrylate, (d) is an acrylic emulsion selected from the group consisting of 2-methyl-2-propenoic acid copolymer with ethyl-2-propenoate, methyl-2-methyl propenoate and 2-propenoic acid, and (e) is predominately water.

5. A method of cleaning and shining a hardwood floor in one step to provide a cleaned and shiny wood surface which also is non-tacky, and free of silicones, which comprises applying the hardwood floor cleaner composition of claim 1 to a hardwood floor and wiping the applied surface cleaner after a predetermined period of application.

* * * * *